US005975457A

United States Patent [19]

Forbes

[11] Patent Number: 5,975,457

[45] Date of Patent: Nov. 2, 1999

[54] WEB FEEDING SYSTEMS

[76] Inventor: Thomas J. Forbes, R.D. 4, Box 211-A, Towanda, Pa. 18848

[21] Appl. No.: 09/036,712

[22] Filed: Mar. 9, 1998

[51] Int. Cl.[6] ..... B65H 19/14

[52] U.S. Cl. ..... 242/552; 242/555.1; 242/555.2; 242/556.1

[58] Field of Search ..... 242/555.1, 555.2, 242/552, 556.1

[56] References Cited

U.S. PATENT DOCUMENTS

| | | | |
|---|---|---|---|
| 3,780,960 | 12/1973 | Tokuno et al. | 242/555.2 |
| 3,880,698 | 4/1975 | Kawazura et al. | 156/504 |
| 4,170,506 | 10/1979 | Marschke | 156/159 |
| 4,219,378 | 8/1980 | Marschke | 156/502 |
| 4,450,039 | 5/1984 | Salvucci et al. | 156/504 |
| 5,033,688 | 7/1991 | Georgitsis et al. | 242/554.2 |
| 5,131,593 | 7/1992 | Siegfried et al. | 156/504 |
| 5,692,698 | 12/1997 | Forbes | 242/533.4 |

*Primary Examiner*—Donald P. Walsh
*Assistant Examiner*—Minh-Chau Pham
*Attorney, Agent, or Firm*—Salzman & Levy

[57] ABSTRACT

The present invention features a web feeding and transition system for exchanging a first, used, web roll for a second, fresh, web roll, so that web material is conveyed along a web-conveying feed path. Each web of the first and second web rolls includes a backing or a separate, interleaved web. The web assembly has a first work station having a mounting for allowing the first web roll to unwind and feed the first web to the feed path. A second work station has a mounting adjacent the first mounting for allowing the second web roll to unwind so that the second web may be spliced to the first web. A "bump splicing" vacuum roll disposed upon the first work station causes an adhesive section of the fresh web to contact an end portion of the exhausting web, as the web roll runs out.

17 Claims, 5 Drawing Sheets

WEB FEEDING SYSTEMS

FIELD OF THE INVENTION

The present invention pertains to a web-roll changing system, wherein a new, successive web roll is exchanged for an old, used web roll, as the web is being conveyed in a continuous manner. Each new web is spliced to the old web as the old web feed roll becomes spent. More particularly, the invention features a web transition and feeding system for webs that have a backing which is stripped therefrom, as each web is unwound, with the backing being stored simultaneously on a separate mandrel as each web is fed to a web conveyor.

BACKGROUND OF THE INVENTION

Web feeding and changing assemblies are well known in the art, as typically illustrated by U.S. Pat. Nos. 3,944,151 (issued to LEE et al on Mar. 16, 1976); 5,354,006 (issued to RÖDER on Oct. 11, 1994); 5,253,819 (issued to BUTLER, Jr., on Oct. 19, 1993); and 5,356,496 (issued to LINCOLN et al on Oct. 18, 1994).

These conventional web-transition assemblies typically exchange a new web of material for a used web, while the old web material is still being conveyed. In this way, the webs are changed "on the fly". A common mechanism for accomplishing this web transition is known in the art as a "bump splicer". The new, unused web comprises an adhesive surface that attaches to the old web through their "bumping" together, as they are simultaneously being conveyed. Thereafter, the web material trailing from the preceding, "old" web is severed at the splice; thus is the transition in the continuous, web-conveying process accomplished.

Exchanging an old web for a new web is a fairly common procedure. However, this procedure represents a long-standing problem, particularly when the web materials comprise backing. Backing material from each web poses a particularly vexatious problem in accomplishing the transition from one web roll to another, since two layers on each web roll must be handled. Not only must each backing be unwound and stored as each web is advanced, but they must also somehow be positioned out of the splicing, or bump zone, so that they do not interfere with the splice mechanism. Despite the profusion of mechanisms and assemblies for changing web materials on the fly, the splicing of a web with a backing was only recently accomplished, as illustrated in U.S. Pat. No. 5,692,698, assigned to a common assignee.

This invention accomplishes the bump splicing of a web with a backing in a more facile, and advantageous manner than its predecessor system. The bump splice mechanism of this invention is less complicated than the revolving turrets of the aforementioned patent. The mechanism of the invention comprises simplified work stations that have movable threading assemblies. The threading of the web can be accomplished at a distance from the exhausting web, thus providing a threading system that is more reliable, convenient, and safer.

Another advantage of the current inventive system resides in its ability to provide for threading the backing material either clockwise or counterclockwise from the web supply roll.

Still a further advantage of the current invention is that the fresh web can be attached to the exhausting web in two different modes: either when the exhausting web is at rest, or when the exhausting web is moving.

SUMMARY OF THE INVENTION

In accordance with the present invention, there is provided a web feeding system for exchanging a first, used web roll for a second, fresh web roll, so that web material is continuously conveyed along a web-conveying feed path. Each web of the first and second web rolls comprises a backing. The web feeding system comprises a first work station having a first movable threading assembly for allowing the first web roll to unwind and feed the first web to the feed path. A second work station comprises a second movable threading station for allowing the second web roll to unwind and feed the second web to the feed path. The second threading assembly allows the second web roll to unwind so that the second web may be spliced to the first web. A bump splicing, vacuum roll disposed on the first work station adheres the first web comprising an adhesive section, to that of the exhausting, second web as it is running out. Each work station also comprises a cutter to sever the trailing edge of either web after a splice has been achieved. The transition assembly comprises a first backing storage mandrel immediately adjacent the first movable threading assembly for storing a first backing material that unwinds from the first web roll onto the first movable threading assembly. The system also comprises a second backing storage mandrel immediately adjacent the second movable threading assembly for storing a second backing material that unwinds from the second web roll, as it unwinds upon the second movable threading assembly.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same numerical designations throughout the FIGURES.

DESCRIPTION OF THE PREFERRED EMBODIMENT

Generally speaking, the invention features a web feeding and transition system for exchanging a first, used, web roll for a second, fresh, web roll, so that web material is continuously fed and conveyed along a web-conveying feed path. Each of the first and second webs comprises a backing or separate, interleaved web. The backing of each web roll is stored on a mandrel adjacent its respective web supply roll, as each web roll unwinds.

Figure 1:
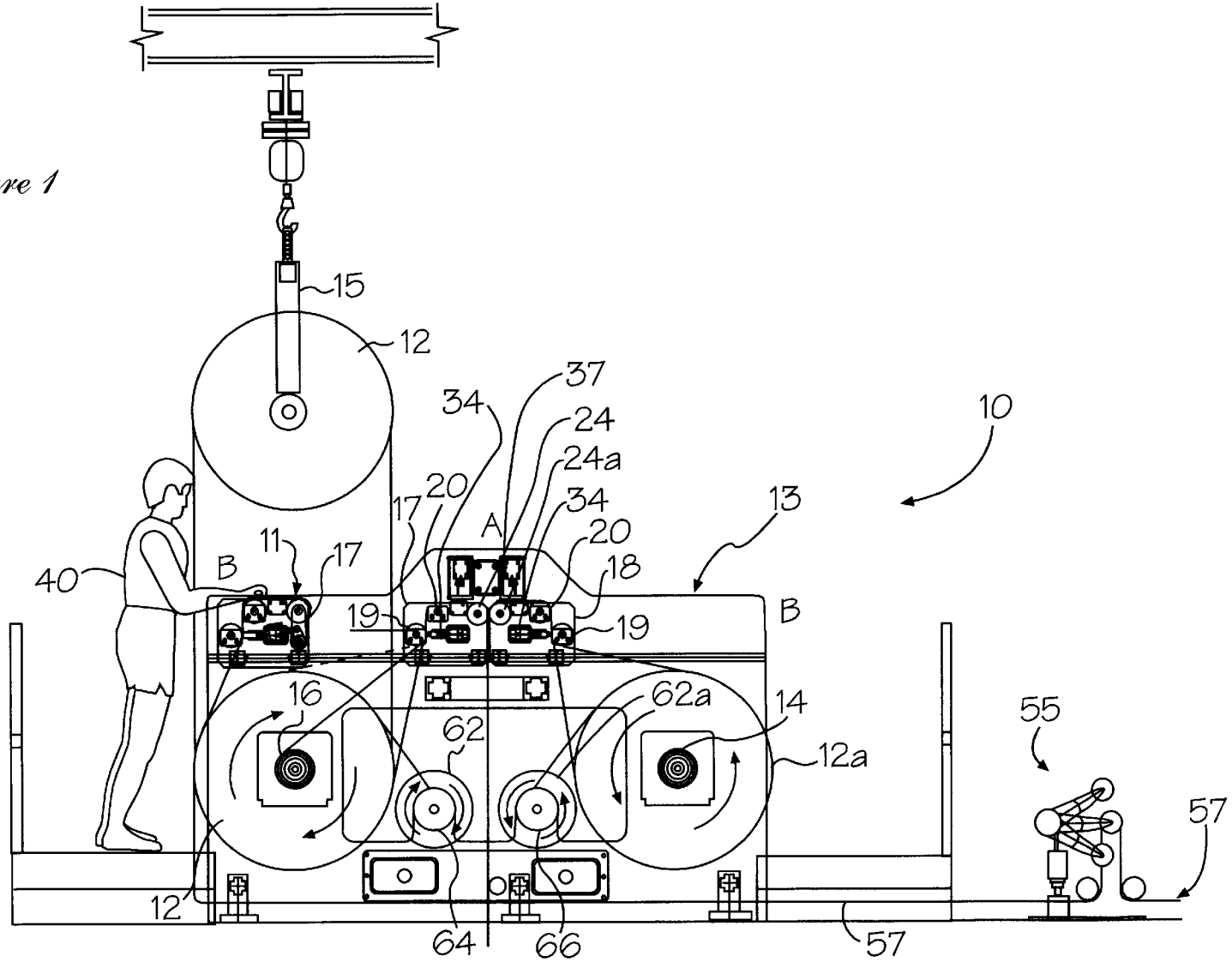
FIG. 1 illustrates a side view of the web splicing system of this invention, having movable web splicing assemblies, each of which is shown in its respective web splicing/feeding position, and with one of the assemblies shown in a phantom threading position. First and second take-up mandrels are shown storing the interleaf materials being unwound from the unwinding web supply rolls.

Now referring to FIG. 1, the web splicing system 10 of this invention is shown. The splicing system 10 consists of two work stations 11 and 13, respectively. The web splicing system 10 is shown prior to splicing a new web supply roll 12 to an expiring web supply roll 12*a* rotatively mounted on a mandrel 14 at work station 13. The new supply roll 12 has been delivered to the work station 11 by a crane 15.

Figure 2:
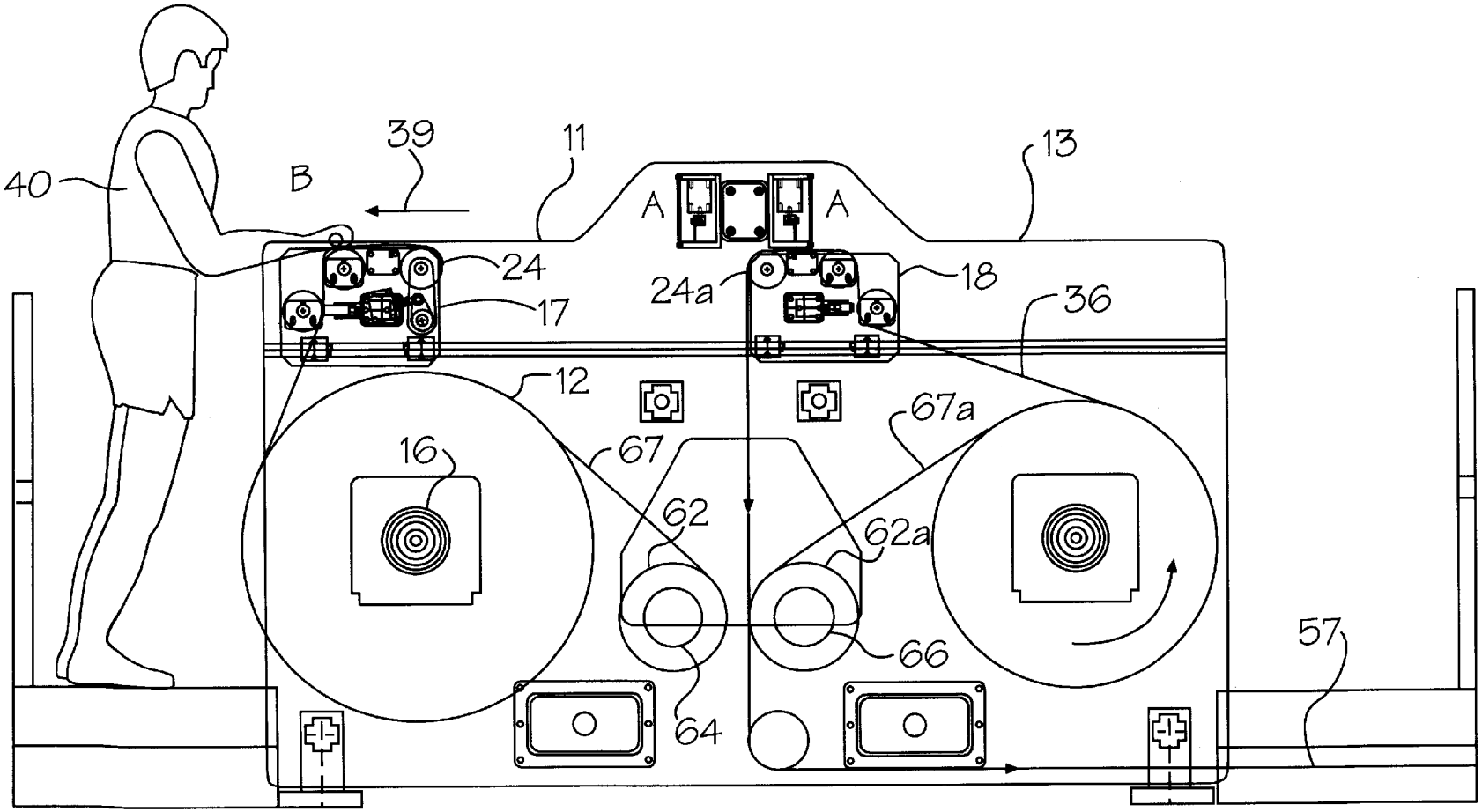
FIG. 2 depicts a slightly enlarged side view of the web splicing system shown in FIG. 1, with one of the movable splicing assemblies in its threading position adjacent an operator.

The replacement supply roll 12 has been mounted on rotatable mandrel 16, as shown. Each work station 11 and 13, respectively, comprises respective movable threading assemblies 17 and 18. Each of the threading assemblies 17 and 18, respectively, is movable between a web splicing/feeding position "A", where it is adjacent the other assembly, as shown in FIG. 1, and a web threading position "B", at an extended location at the end of respective work stations 11 and 13. Assembly 17 is shown in phantom at position "B". The movement of assembly 17 to its "B" position can be better observed in FIGS. 2 and 3.

Figure 3:
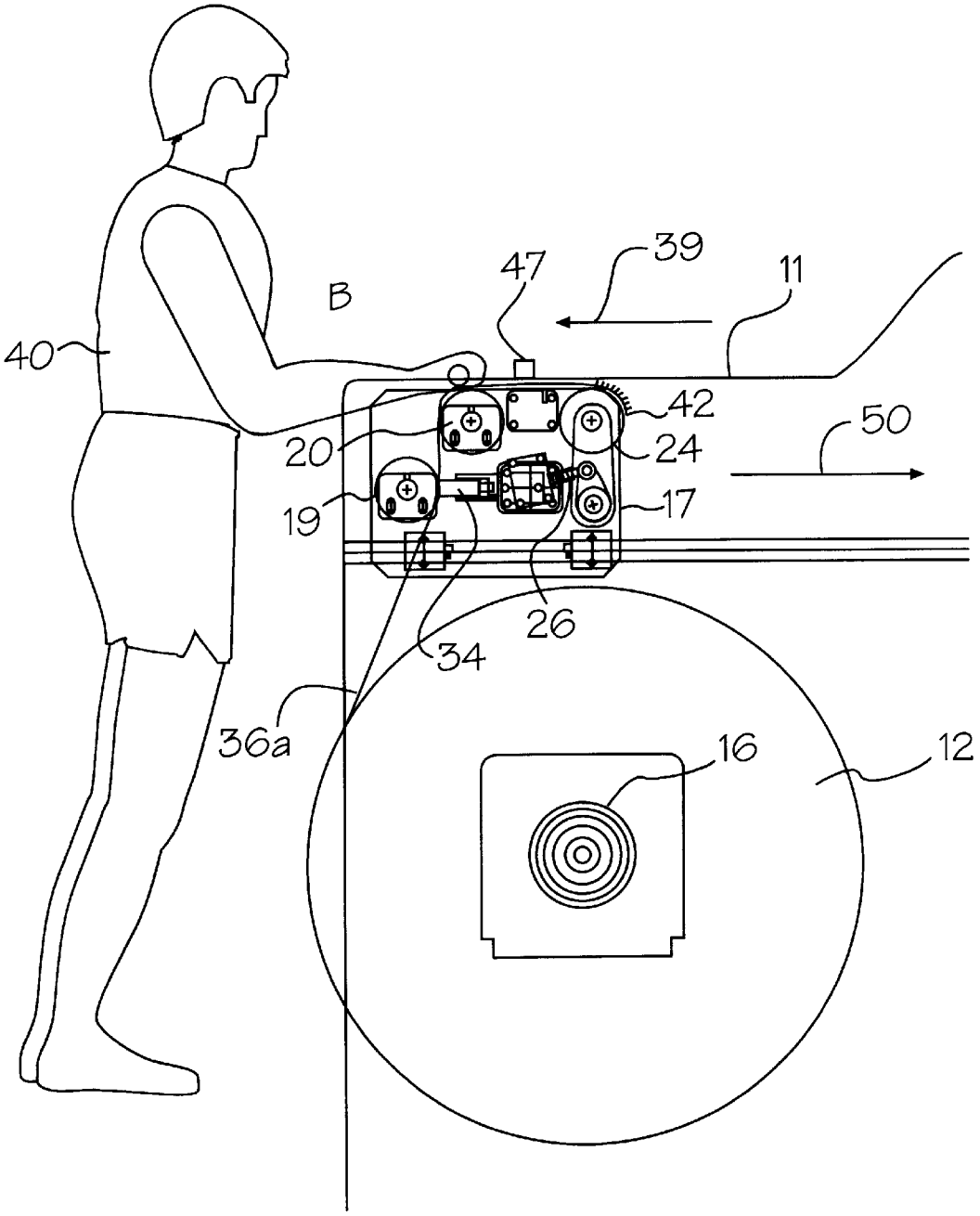
FIG. 3 shows a greatly enlarged side view of the movable assembly depicted in FIG. 2, as it is being threaded by the operator of the web splicing system.
Figure 4:
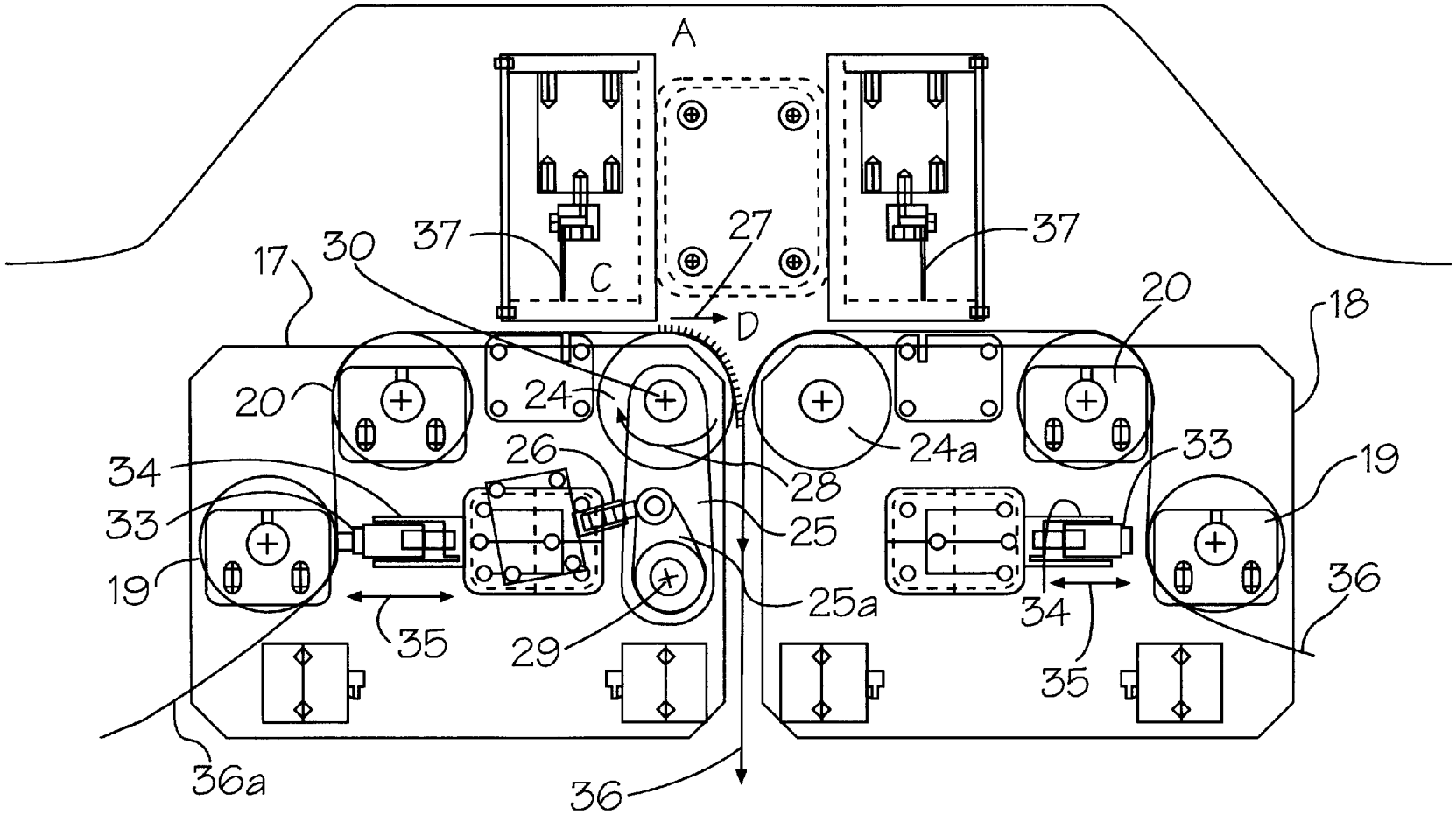
FIG. 4 illustrates an enlarged view of the web splicing assemblies shown in FIG. 1, disposed at their splicing/feeding positions, with a new replacement web having been threaded on the right assembly.

Each assembly 17 and 18 has two juxtaposed threading rolls 19 and 20, better seen with reference to FIGS. 3 and 4. The juxtaposed threading rolls 19 and 20 allow the web to be snaked between them, thus creating web tension therebetween. The juxtaposed threading rolls 19 and 20 are rotatably fixed to their respective movable assembly 17 and 18.

Respective vacuum rolls 24 and 24*a* have a series of air holes disposed therein (FIG. 5), for drawing a vacuum upon the leading edge of a replacement web. The vacuum rolls are rotatively secured to each respective assembly 17 and 18. Each vacuum roll 24 and 24*a* is respectively disposed adjacent the two juxtaposed threading rolls 19 and 20. The vacuum roll 24 of the movable threading assembly 17 is pivotally operative (arrow 27) between a splicing position "D" and a non-splicing position "C", as illustrated in FIG. 4, by virtue of being pivotally mounted upon crank arm 25, connected to, and powered by, a pneumatic piston 26 that moves inferior crank 25*a*.

The inferior crank arm 25*a* is pivotally secured to larger crank arm 25 about pivot point 29, so that they both pivot under the influence of pneumatic piston 26. The bigger crank arm 25 supports the vacuum roll 24 for pivotable movement (arrow 27) about pivot point 29 and for rotation (arrow 28) about the support shaft 30 to which it is rotatively secured. The pivoting of the vacuum roll 24 is such that it is caused to move between its respective splicing and non-splicing positions "D" and "C", as will be further explained hereinafter.

Figure 5:
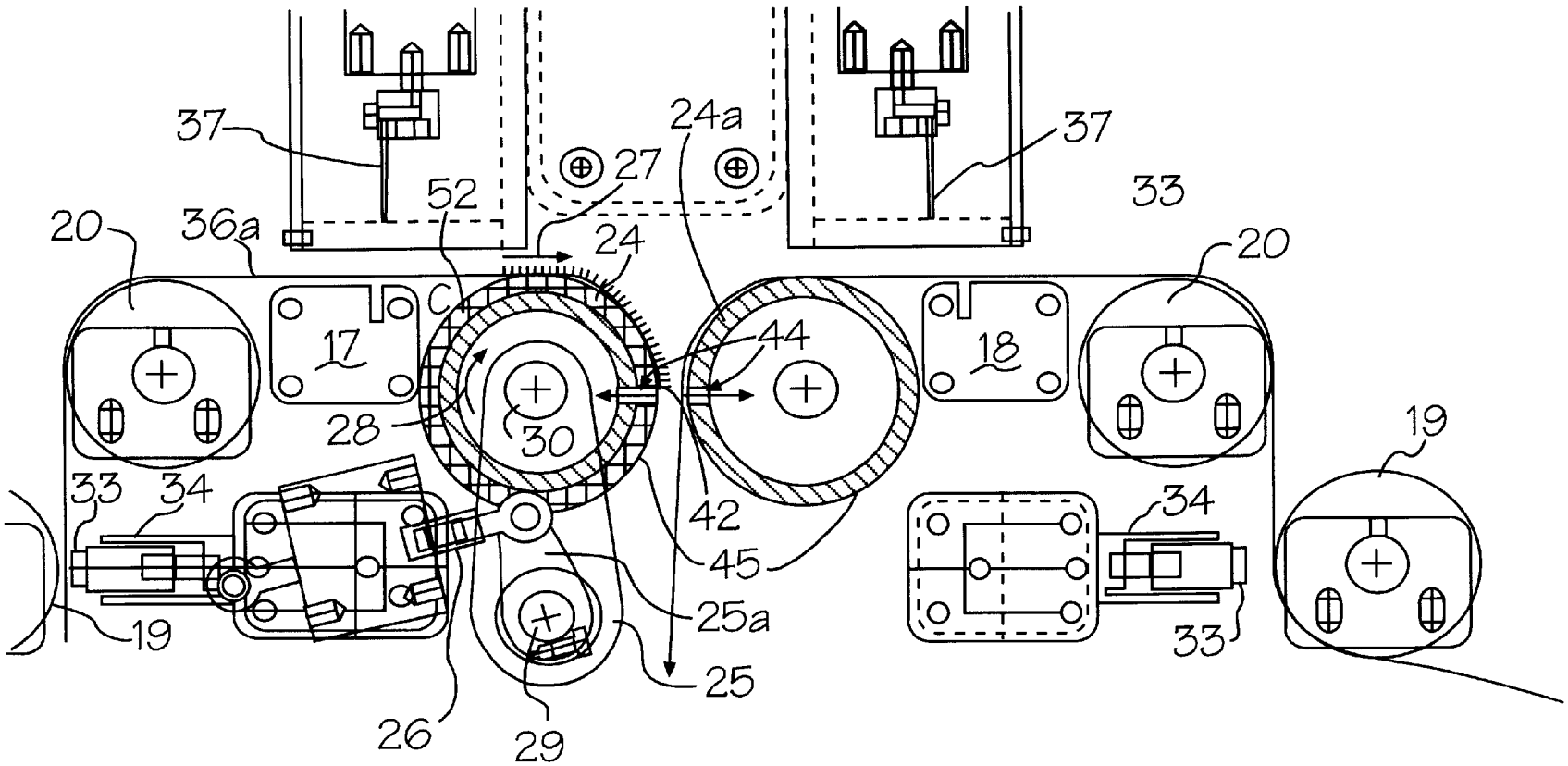
FIG. 5 shows a greatly enlarged view of the web splicing assemblies depicted in FIG. 4, which enlarged view provides greater structural details of the feed and threading rolls.

A pneumatic piston 34 is also connected to a web clamp 33 disposed adjacent the first juxtaposed threading roll 19 of each of the respective movable assemblies 17 and 18. The pneumatically controlled clamps 34 of each assembly are movable between a web clamping position adjacent each first juxtaposed roll 19 and a non-clamping position at a non-extended position with respect to said respective first juxtaposed roll 19, as illustrated by arrows 35. The vacuum roll 24 of the second movable assembly 18 is positioned in place. The pneumatic piston of this assembly operates and connects only to the web clamp 34 disposed adjacent the first juxtaposed threading roll 19. A pneumatically controlled cutting knife 37 is disposed between the vacuum roll 24 and second juxtaposed threading roll 20 of each assembly 17 and 18, as shown in FIGS. 4 and 5.

Referring again to FIGS. 1 and 2, interleaf take-up rolls 62 and 62*a* are shown mounted upon mandrels 64 and 66, on respective work stations 11 and 13. Respective interleaf sheets 67 and 67*a* are wound upon their respective mandrels 64 and 66 in either a clockwise or a counterclockwise direction, depending on the way the main supply rolls 12 and 12*a* are threaded into their respective movable threading assemblies 17 and 18.

OPERATION OF THE SPLICING SYSTEM

The splicing system 10 operates so that a second web supply roll 12*a* (FIG. 1), that is about to become exhausted, is threaded through the second assembly 18 disposed at its splicing position "A". The old web 36 is movably threaded around the juxtaposed threading rolls 19 and 20, respectively, and the vacuum roll 24, the vacuum of which is inoperative in free flow. The web is freely flowable about all three threading rolls 19, 20, and 24, respectively. The pneumatic piston 34 controlling the clamp for the first juxtaposed threading roll 19 is nominally in its non-extended position. As the second web 36 is about to become exhausted, the operator 40 of the splicing system 10 mounts a new web supply roll 12 upon the mandrel 16 located at the first work station 11. After the new supply roll is rotatively secured upon the mandrel 16, the operator 40 withdraws (arrow 39, FIGS. 2 and 3) the first assembly 17 from its web splicing/feeding position "A" to its web threading position "B" located adjacent the operator 40. The operator 40 then proceeds to thread the new supply web about the three threading rolls 19, 20, and 24, respectively. The leading edge 42 of the new, replacement web 36*a* (FIG. 3) is positioned about the vacuum roll 24, as illustrated. The vacuum roll 24 is actuated to draw its vacuum through perforations 44 in the surface 45 of the vacuum roll 24, as shown in FIG. 5.

Referring again to FIG. 3, the leading edge 42 of the web 36*a* is pressure adhered to the vacuum roll 24. The pneumatic piston 34 is actuated to move the web clamp 33 into adjacent contact with the first juxtaposed threading roll 19. The interdisposed new web 36*a* is held firmly to the first juxtaposed threading roll 19. This prevents the new web 36*a* from tending to slip backwardly and withdraw into the new supply roll 12. The new web 36*a* being firmly threaded within the first assembly 17, the operator 40 pushes a button 47 (FIG. 3) disposed on top of a control panel (not shown) that moves (arrow 50) the first assembly 17 into its splicing/feeding position "A".

When the first assembly 17 moves (arrow 50) into the splicing/feeding position "A", as illustrated in FIG. 4, the pneumatic piston 26 of the assembly 17 actuates and causes the crank arms 25*a* and 25 to move the vacuum roll 24 and its respective web 36*a* into contact with the old web 36 disposed on the second vacuum roll 24. At the same time, the first clamp 33 is moved to its non-extended position, thus releasing the new web 36*a* for movement about the first juxtaposed threading roll 19. The leading edge 42 of the new web 36*a* has an adhesive surface 54 that adheres to the old, second web 36, when the two vacuum rolls 24 come into contact at point "D". The new web 36*a* is therefore spliced to the old web 36. Simultaneously therewith, the second cutting blade 37 is pneumatically actuated, thus severing the old web 36 from its respective supply roll 12*a*, thus completing the splicing operation.

When the new web 36*a* becomes exhausted, a new, second web supply roll 12*a* is mounted upon the second work station 13 and the second movable assembly 18 is withdrawn from the splicing/feeding position "A". After threading the new, second web onto the second assembly 18, in a manner similar to that previously described for the first assembly 17, the operator 40 pushes a button 47 at the second work station 13 to actuate the splice sequence once again. The crank arm 25 of the first assembly 17 causes the first vacuum roll 24 to contact the second vacuum roll 24*a*, thus causing contact of the old, first web, with the new, second web. The second clamp 33 is caused to move to its non-extended position, thus freeing the second, new web 36*a* for movement with respect to the first juxtaposed roll 19 of the second assembly 18. The vacuum is released on the second vacuum roll 24*a*. The first cutting knife 37 then cuts the first, old web 36*a*, thus completing the splice, as before.

An accumulator device, or "dancer" 55 (FIG. 1) is located downstream from the first and second work stations 11 and 13, respectively, along the web feed path 57, in order to maintain the proper tension in the moving web during the splice. The splicing system of this invention is configured to allow for the splice when the web is either stationary or moving. The timing of each component during the splicing sequence can comprise simple electronic relay or delay mechanisms.

Referring again to FIGS. 1 and 2, the interleaf sheets 67 and 67*a* are wound upon their respective mandrels 64 and 66, forming interleaf rolls 62 and 62*a*, respectively, when the main supply rolls 12 and 12*a* are threaded into movable threading assemblies 17 and 18, respectively. As aforementioned, the interleaf sheets 67 and 67*a* can be wound either clockwise or counterclockwise, depending on the threading direction of the main webs.

Referring again to FIG. 5, the vacuum roll 24 of movable assembly 17 comprises an outer elastomeric cover 52 for providing a shock resilient surface. The elastomeric material of cover 52 can be rubber, neoprene, etc. The shock resilient surface could be part of vacuum roll 24*a*, instead of vacuum roll 24. However, one shock resilient surface is required between the two vacuum rolls 24 and 24*a*, in order to provide a quiet and smooth contact when vacuum roll 24 moves (arrow 27) from position "C" to contact position "D".

The end section of the replacement web is covered with an adhesive strip from the leading edge 42 of the web 36*a* to the area below the cutting knife apparatus 37. A protective tear-off strip exposes the sticky adhesive so that, when the two vacuum rolls 24 and 24*a* come into contact, the two respective webs 36*a* and 36 bond together, thus completing the splice.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A web feeding and transition system for exchanging a first, spent, web roll for a second, fresh, web roll, so that web material will be continuously fed and conveyed along a web-conveying feed path, comprising:

a web-conveying feed path;

a first web roll containing at least a first web having a first backing material, said first web roll disposed adjacent said web-conveying feed path;

a second web roll containing at least a second web having a second backing material;

means for respectively, rotationally mounting said first web roll and said second web roll in juxtaposition thereto, wherein said first and second web rolls are capable of unwinding, so as to be fed along said web-conveying feed path;

storage means disposed adjacent said first and second web rolls having means for respectively storing said first and second backing materials in one of either a clockwise or counterclockwise direction, whereby said backing material can be threaded from said first web roll in either a clockwise or counterclockwise rotation from the web supply roll; and splicing means disposed adjacent said first web roll for splicing said second web to said first web when said first web roll becomes substantially spent.

2. The web feeding and transition system in accordance with claim 1, wherein said respective first and second webs are each threaded upon a movable threading assembly.

3. The web feeding and transition system in accordance with claim 2, wherein said movable threading assemblies are each movable between a splicing/feeding position and a threading position.

4. The web feeding and transition system in accordance with claim 3, wherein each of said movable threading assemblies is slidably movable upon a respective work station.

5. The web feeding and transition system in accordance with claim 1, further comprising an accumulator disposed along said web-conveying feed path for adjusting tension in said web as it moves therethrough.

6. The web feeding and transition system in accordance with claim 1, wherein said splicing means further includes a bump splicer and cutting means.

7. A web feeding and transition system for exchanging a first, spent, web roll for a second, fresh, web roll, so that web material will be continuously fed and conveyed along a web-conveying feed path, comprising:

a web-conveying feed path;

a first work station for receiving a first web roll containing at least a first web having a first backing material, said first work station being disposed adjacent said web-conveying feed path;

a second work station for receiving a second web roll containing at least a second web having a second backing material, and an adhesive portion disposed upon a front section of said second web for effectuating a splice with said first web;

means for respectively, rotationally mounting said first web roll and said second web roll in juxtaposition thereto, wherein said first and second web rolls are capable of unwinding, so as to be fed along said web-conveying feed path;

storage means disposed adjacent said first and second web rolls for storing backing materials and having means for unwinding from said first and second web rolls, respectively, in one of either a clockwise or counterclockwise direction, whereby said backing material can be threaded from said first web roll in either a clockwise or counterclockwise rotation from the web supply roll; and splicing means disposed adjacent said first web roll for splicing said second web to said first web by bringing into contact said adhesive portion of said second web with a trailing portion of said first web.

8. The web feeding and transition system in accordance with claim 7, wherein said respective first and second webs are each threaded upon respective movable threading assemblies.

9. The web feeding and transition system in accordance with claim 8, wherein said movable threading assemblies are each movable between a splicing/feeding position and a threading position.

10. The web feeding and transition system in accordance with claim 9, wherein each of said movable threading assemblies is slidably movable upon said respective first and second work station.

11. The web feeding and transition system in accordance with claim 7, further comprising an accumulator disposed along said web-conveying feed path for adjusting tension in said web as it moves therethrough.

12. The web feeding and transition system in accordance with claim 7, wherein said splicing means further includes a bump splicer and cutting means.

13. A web feeding and transition system for exchanging a first, spent, web roll for a second, fresh, web roll, so that web material will be continuously fed and conveyed along a web-conveying feed path, comprising:

a web-conveying feed path;

a first work station having first movable threading means for threading a first web roll containing at least a first web having a first backing material, said first work station being disposed adjacent said web-conveying feed path;

a second work station having second movable threading means for threading a second web roll containing at least a second web having a second backing material;

means for respectively, rotationally mounting said first web roll and said second web roll in juxtaposition thereto, wherein said first and second web rolls are capable of unwinding, so as to be fed along said web-conveying feed path;

storage means disposed adjacent said first and second web rolls for storing said first and second backing materials, respectively; and splicing means disposed adjacent said first web roll for splicing said second web to said first web, said splicing means further comprising means for attaching said second web to said first web in two different modes: either when the first web is at rest, or when the first web is moving.

14. The web feeding and transition system in accordance with claim 13, wherein said movable threading assemblies are each movable between a splicing/feeding position and a threading position.

15. The web feeding and transition system in accordance with claim 13, wherein each of said movable threading assemblies is slidably movable upon said respective first and second work stations.

16. The web feeding and transition system in accordance with claim 13, further comprising an accumulator disposed along said web-conveying feed path for adjusting tension in said web as it moves therethrough.

17. The web feeding and transition system in accordance with claim 13, wherein said splicing means further includes a bump splicer and cutting means.

* * * * *